US006300550B1

(12) United States Patent
Smith

(10) Patent No.: US 6,300,550 B1
(45) Date of Patent: Oct. 9, 2001

(54) RETROFIT GUITAR TREMOLO

(76) Inventor: Alexander M. Smith, 203 Roller Ave., Beaver Dam, WI (US) 53916

( * ) Notice: Subject to any disclaimer, the term of this patent is extended or adjusted under 35 U.S.C. 154(b) by 0 days.

(21) Appl. No.: 09/519,361

(22) Filed: Mar. 6, 2000

(51) Int. Cl.[7] ..... G10D 3/04
(52) U.S. Cl. ..... 84/298; 84/299; 84/307
(58) Field of Search ..... 84/298, 299, 307, 84/313

(56) References Cited

U.S. PATENT DOCUMENTS 4,549,460 * 10/1985 Gressett, Jr. et al. ..... 84/298
5,088,374 * 2/1992 Saijo ..... 84/313
5,173,565 * 12/1992 Gunn ..... 84/298
5,413,019 * 5/1995 Blanda, Jr. ..... 84/298
6,015,945 * 1/2000 Borisoff ..... 84/313

* cited by examiner

*Primary Examiner*—Shih-Yung Hsich
(74) *Attorney, Agent, or Firm*—Donald Cayen

(57) ABSTRACT

A retrofit tremolo is designed to replace an existing tremolo in a guitar or other musical instrument. The retrofit tremolo has a bridge that removeably holds a pair of knife edge inserts. The knife edge inserts are contactable with posts embedded in the instrument. The knife edge inserts are replaceable when they become worn. A spring plate on the bridge is connectable with springs on the instrument existing from the previous tremolo that is replaced. The instrument strings are supported by rollers on intonation blocks. Fine tuners engage the bridge between the intonation block rollers and ends of the strings anchored in the bridge. The fine tuners have respective tips with semi-cylindrical ends and V-shaped notches. The semi-cylindrical ends aid in fitting the strings within the notches during tremolo setup.

4 Claims, 2 Drawing Sheets

RETROFIT GUITAR TREMOLO

BACKGROUND OF THE INVENTION

1. Field of the Invention.

This invention pertains to tremolos, and more particularly to simplified tremolos that replace original equipment.

2. Description of the Prior Art.

It has long been known to equip guitars and other stringed musical instruments with tremolos. The tremolos enable the instrument player to change the tension in the strings when desired and thereby change the tuning of the strings.

Tremolos typically have at least three places at which relative movement of the various components occur. The first is a pivot arrangement at which the entire tremolo pivots relative to the instrument body. A common pivot arrangement is a pair of knife edges on a tremolo bridge that pivot on grooved posts that are embedded in the instrument body. Typical examples of prior knife edge and post designs are shown in U.S. Pat. Nos. 4,549,461 and 5,708,225.

A second place of relative movement between tremolo components is at intonation blocks on the bridge. The intonation blocks are moveable relative to the bridge and the instrument strings to set the effective span of the strings. Once the intonation blocks are locked in place when the tremolo is initially set up, they rarely have to be moved again. Typical prior tremolo intonation blocks can be seen in U.S. Pat. Nos. 5,481,955 and 5,808,216.

A third place of relative movement between tremolo parts is at fine tuners. The fine tuners are designed to change the tension in the instrument strings by small amounts and thereby vary the string tonal qualities. Prior fine tuners are shown in U.S. Pat. Nos. 5,431,079 and 5,460,072.

For various reasons, the prior tremolos are not entirely satisfactory. As one reason, the knife edges of the prior tremolos tend to wear with usage. As they wear, their pivoting action on the instrument posts becomes unreliable and inconsistent. However, replacing the knife edges of prior tremolos is not possible without replacing the entire tremolo. Accordingly, it is a major inconvenience and expense to overcome the problems associated with worn knife edges.

Another deficiency of prior tremolos concerns the fine tuners. In the tremolo of the U.S. Pat. No. 5,431,079 patent, for example, there is a first sharp bend in the strings at their contacts with the fine tuners. There is another sharp bend in the strings at their contact points with the intonation blocks. The two sharp bends tend to weaken the strings, and the strings usually break at one or other of the bends. Further, prior fine tuners were designed with flat ends that contacted the strings. The strings easily and frequently slipped off the ends of the fine tuners as they were being adjusted, and it was a chore to return the strings back into contact with the fine tuners.

Prior tremolos were also infamous for the large number of small and expensive parts associated with the intonation blocks and fine tuners. Assembling the numerous small parts added further to the cost of the tremolos. U.S. Pat. Nos. 5,109,745 and 5,477,765 show large numbers of small parts assembled into an expensive tremolo.

Because of the problems associated with prior tremolos, it is frequently necessary to replace them. However, because of their expense, instrument owners were hesitant to replace unsatisfactory tremolos with new ones, which were prone to the same problems. In the past, different model tremolos were not designed to be interchangeable with one another on an instrument. That is, after a particular tremolo model was installed in an instrument, replacing that tremolo with a different and less expensive model was invariably a difficult and even unworkable task.

Thus, a need exists for a practical way to replace prior tremolos with an improved model.

SUMMARY OF THE INVENTION

In accordance with the present invention, a simplified retrofit tremolo is provided that easily replaces an unsatisfactory existing tremolo on a stringed instrument. This is accomplished by designing the retrofit tremolo to be interchangeable with and superior to the existing tremolo.

The retrofit tremolo combines a string anchoring block, intonation block supports, and a spring plate into one T-shaped bridge. The construction of the retrofit tremolo is thus greatly simplified compared to the tremolos it replaces.

The bridge has front and back ends, opposite sides, and a generally flat bottom surface. The spring plate depends from the bridge bottom surface. The block is adjacent the bridge back end. The intonation block supports are part of a bridge support plate that extends from the block to the bridge front end.

In a guitar, the frets on the neck define aligned arcs of large radius. To match the arcs, the bridge support plate is formed with a series of steps. The steps on the bridge support plate are designed such that the strings passing over the intonation blocks lie along the same arc as the instrument frets.

The strings make a shallow bend between the intonation blocks and pockets on the back end of the bridge block. The pockets receive the ball ends of the strings. The strings pass through respective slits in the block. There is ample clearance between the strings and the bottoms of the block slits. Thumb screws of fine tuners engage tapped holes in the block associated with the respective slits. The ample clearance in the slits under the fine tuners assures that a wide range of pitch change is available by turning the thumb screws. The thickness of the bridge support plate provides the further advantage of furnishing a large bearing area for a tremolo arm.

At the bridge front end near the sides are a pair of knife edges. The knife edges are designed to contact and pivot relative to posts embedded in the instrument.

Further in accordance with the present invention, worn knife edges are removable from the bridge. For that purpose, the knife edges are on inserts that are held tightly by friction in respective recesses at the bridge front end. Although the inserts are held tightly in the bridge, they nevertheless are removable when desired by pulling them with a pliers or similar tool.

It is a feature of the invention that the fine tuners have grooved tips that engage the strings. The tips are rotatable about the longitudinal axes of the thumb screws. The tip grooves prevent the strings from slipping off the ends of the fine tuners when the thumb screws are rotated to change the string pitch. To aid in guiding a string into a tip groove during setup, the free ends of the tips are rounded in planes perpendicular to the grooves.

The spring plate is designed to enable the springs of an original tremolo to be used with the retrofit tremolo. A person merely disconnects the existing springs from the spring plate of the original tremolo. The springs are not removed from the instrument. The springs fit perfectly onto the retrofit tremolo.

To prevent binding or catching of the strings on the intonation blocks, the strings pass over small rollers incorporated into the intonation blocks. In keeping with the purpose of making the retrofit tremolo as simple as possible, the roller of each intonation block is supported by a pin between two side walls of the intonation block. A base on the intonation block is slotted to receive a screw that locks the intonation block to the bridge at a location that sets the desired span of the associated string.

The method and apparatus of the invention, using components that match existing tremolo-related components on a stringed instrument, thus enables a person to retrofit the instrument with a superior but less expensive tremolo. The retrofit tremolo is economical, simple in construction, and very easy to install and set up, even though it contains relatively few components.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 10:
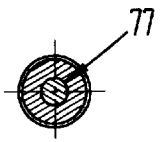
FIG. 10 is a cross-sectional view taken along line 10—10 of FIG. 9.
Figure 2:
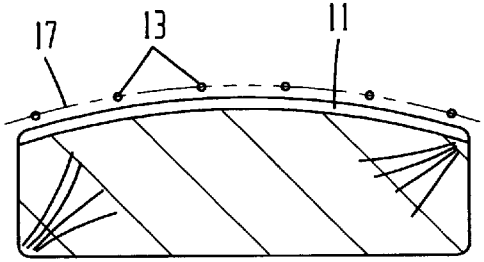
FIG. 2 is a cross-sectional view on an enlarged scale taken along line 2—2 of FIG. 1.
Figure 8:
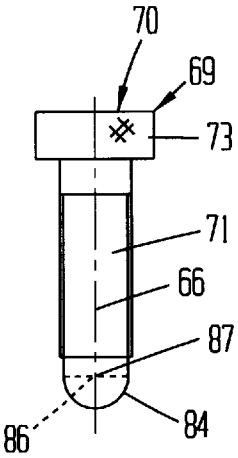
FIG. 8 is a front view on an enlarged scale of the fine tuner of the invention.
Figure 9:
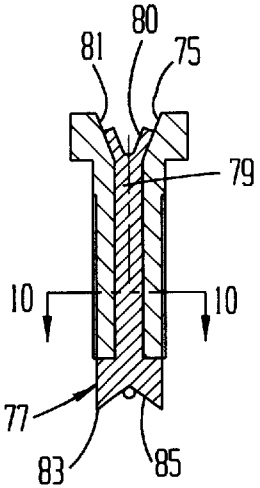
FIG. 9 is a longitudinal cross-sectional view of the fine tuner of FIG. 8.
Figure 1:
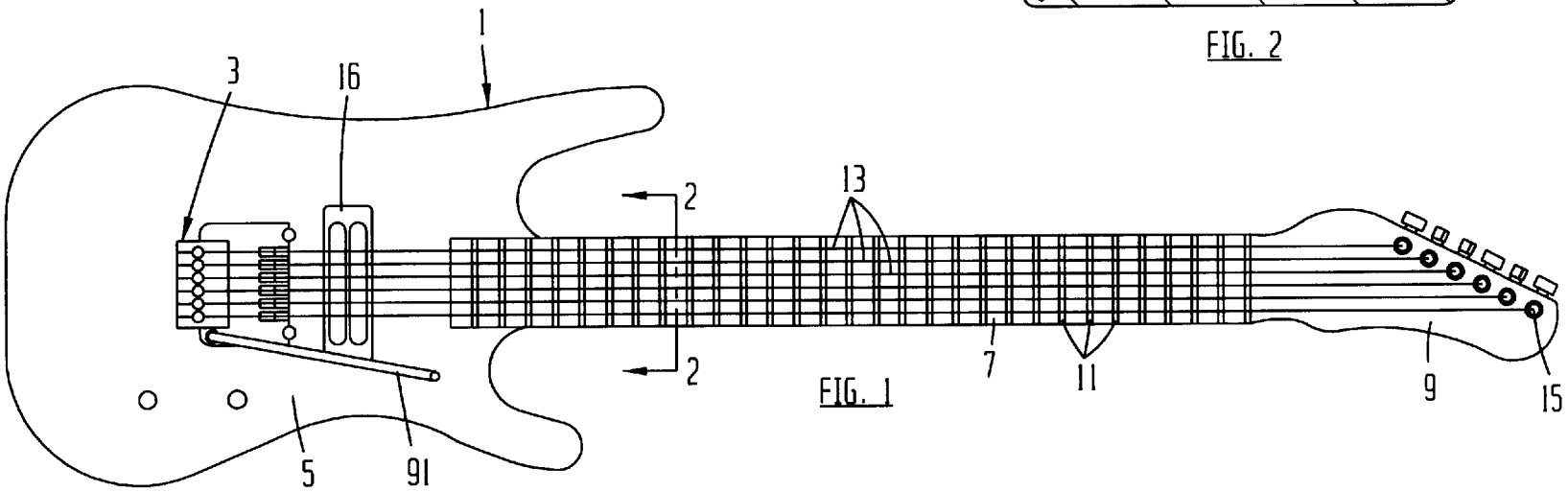
FIG. 1 is a front view of a typical guitar that is equipped with the retrofit tremolo of the invention.

Referring to FIGS. 1 and 2, a retrofit tremolo 3 is illustrated that includes the present invention. The retrofit tremolo 3 is particularly useful with an electric guitar 1. However, it will be understood that the invention is not limited to use with any particular type of stringed instrument.

For illustrative purposes, the guitar 1 is shown as having a body 5, a neck 7, and a head 9. A number of frets 11 extend transversely across the neck 7. Several strings 13 are adjustably connected at one end to respective tuning pegs 15 on the guitar head 9. The second ends of the strings 13 are anchored in the retrofit tremolo 3, as will be described shortly. Reference numeral 16 represents electronic pickups that are used to amplify the sounds produced by the strings in a well known manner.

As best shown in FIG. 2, the guitar frets 11 have a convex shape in a transverse plane. Accordingly, the strings 13 lie in a curved plane 17.

Looking also at FIGS. 3–7, the guitar 1 to be equipped with the retrofit tremolo 3 has a cutout 19 through its body 5. There is a recess 21 next to the cutout 19 in the back side 23 of the guitar body. A clip 25 is attached to the guitar body in the recess 21, as by screws 27. One or more springs 29 are connected to the clip 25. The clip 25 and springs 29 are normally part of an existing tremolo, not shown, previously installed on the guitar that is to be replaced with the retrofit tremolo 3.

The guitar 1 also includes a pair of posts 31 embedded into the top side 33 of the body 5. Each post 31 has a circumferential groove 35, which is usually V-shaped.

In the preferred embodiment, the retrofit tremolo 3 is comprised of a bridge 37 having a front end 38, a back end 40, opposed sides 42, and a bottom surface 36. At its back end 40, the bridge 37 has a block 39. There is a bridge support plate 41 between the block 39 and the bridge front end 38. A spring plate 43 depends from the bottom surface 36.

The retrofit tremolo 3 further comprises a pair of inserts 44 having respective concave knife edges 46. The inserts 44 are held tightly in corresponding recesses 48 in the bridge support plate 41. To enable the knife edges 46 to contact the grooves 35 in the guitar posts 31, the bridge support plate has concave reliefs 34 generally concentric with the insert knife edges. The inserts are made of hardened steel, so they wear a long time. Nevertheless, over time the knife edges 46 tend to wear. To replace a worn insert, a person pulls it out of the bridge recess 48 with a needle nose pliers or similar tool. To aid in removing the inserts, the bridge support plate is cut back from each relief 34 between the bottom surface 36 and the recess 48 with an indentation 50. The indentations 50 provide larger exposed areas of the inserts available from the bottom surface 36 for the pliers to grip. The indentations are also very helpful when the fresh inserts are pushed into the recesses.

A principle feature of the invention is that the retrofit tremolo 3 is assembled to the guitar 1 with a minimum of expense and effort. To assemble the retrofit tremolo, the bridge spring plate 43 is inserted into the guitar cutout 19. The knife edges 46 are placed in contact with the posts 31. The ends 52 of the springs 29 from the original tremolo are connected to the bridge spring plate.

The bridge block 39 has a number of slits 45 that are aligned with the strings 13 when the retrofit tremolo 3 is assembled to the guitar 1. There is a pocket 47 in the bridge block at the back end 40 in line with each slit 45. The ball ends of the strings are received in the respective pockets 47.

The bridge support plate 41 supports a number of intonation blocks 49. There is an intonation block 49 for each string 13, and the intonation blocks are aligned with the strings and the block slits 45. Each intonation block has a base 51 with a slot 53 through it at its front end 55. A tongue 57 on the bottom of the base 51 mates with a groove 59 in the bridge support plate. In that manner, the intonation blocks can slide in directions parallel to the strings but cannot move transversely relative to the strings. A screw 61 passing through each intonation block slot 53 and engaging a threaded hole in the bridge support plate locks the intonation block at a desired location along the support plate groove 59.

It is a feature of the invention that each intonation block 49 is formed with walls 63 that upstand from the base 51. To support the associated string 13, each intonation block further comprises a roller 65 that is held between the walls 63 by a pin 67 that passes through aligned holes in the walls.

According to one aspect of the invention, the pin 67 is knurled at one end to make a tight but economical fit in the associated intonation block wall.

Figure 6:
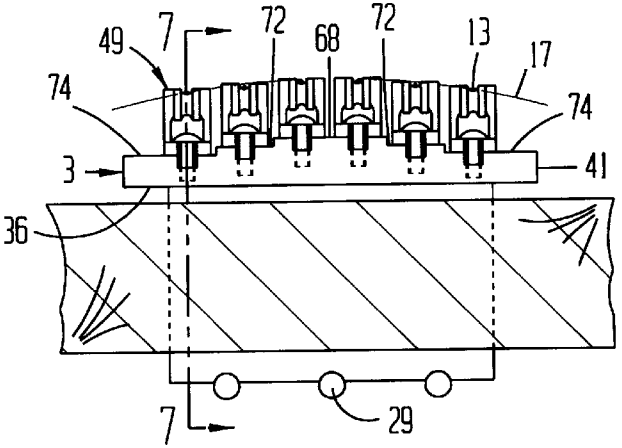
FIG. 6 is a cross-sectional view taken along line 6—6 of FIG. 7.

As mentioned, the guitar frets 11 are designed such that the strings 13 lie along a curved plane 17, FIG. 2. To maintain the same plane 17 of the strings at the retrofit tremolo 3, the bridge support plate 41 is formed with a series of steps as best seen in FIG. 6. Specifically, there is a middle step 68 at a distance above adjacent side steps 72. In turn, the side steps 72 are at a selected distance above the top surface 74 of the bridge support plate. The distance of the steps 68 and 72 above the bridge support plate top surface 74 is chosen such that the strings 13 lie in the curved plane 17 at the intonation blocks 49.

When the strings 13 are assembled with the retrofit tremolo 3, they are divided into respective first and second sections 13A and 13B. The first section 13A of each string is between the associated intonation block roller 65 and tuning peg 15. The second section 13B is between the associated roller and pocket 47. The string section 13B makes an angle A with the section 13A.

The retrofit tremolo 3 further comprises a fine tuner 69 in association with each string 13. Each fine tuner 69 is composed of a thumb screw 70 having a longitudinal centerline 66, a threaded shank 71, and a knurled head 73. Loosely captured in the interior 75 of the thumb screw 70 is an end piece 77. The end piece 77 has a long rod 79 that fits in the thumb screw interior 75. One end 80 of the rod 79 is peened over against a frusto-conical portion 81 of the thumb screw interior. On the other end of the rod is a tip 83. The tip 83 has a semi-cylindrical surface 84 on the end opposite the rod 79. A V-shaped notch 85 is formed in the surface 84. The apex 86 of the notch 85 is perpendicular to the axis 87 of the surface 84.

The fine tuners 69 are threaded into corresponding tapped holes 89 in the bridge block 39. The fine tuner longitudinal centerlines 66 are perpendicular to the string sections 13B. That is, the holes 89 make an angle B with the string section 13A; the angle B is the compliment of angle A. By turning the thumb screws 70, the tensions in the strings 13 are changed to change the pitch of the strings. The rounded surfaces 84 on the fine tuner tips 83 greatly assist the tip notches 85 to engage the strings when the fine tuners are threaded into the holes 89.

Figure 7:
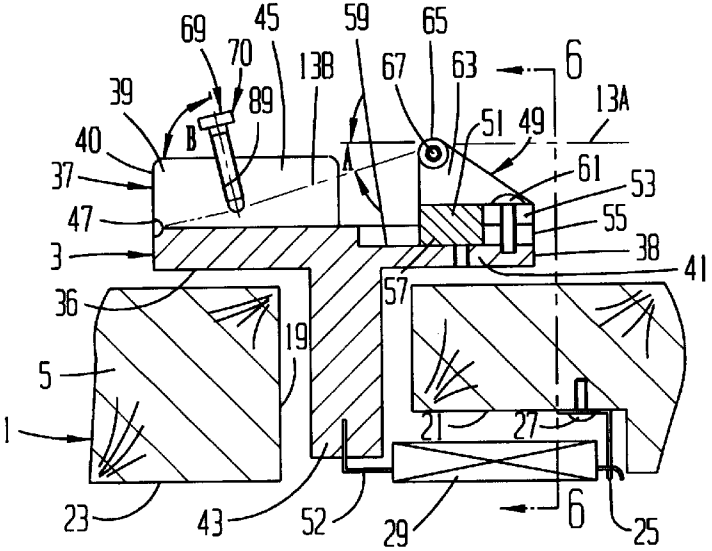
FIG. 7 is a cross-sectional view taken along line 7—7 of FIG. 6.
Figure 3:
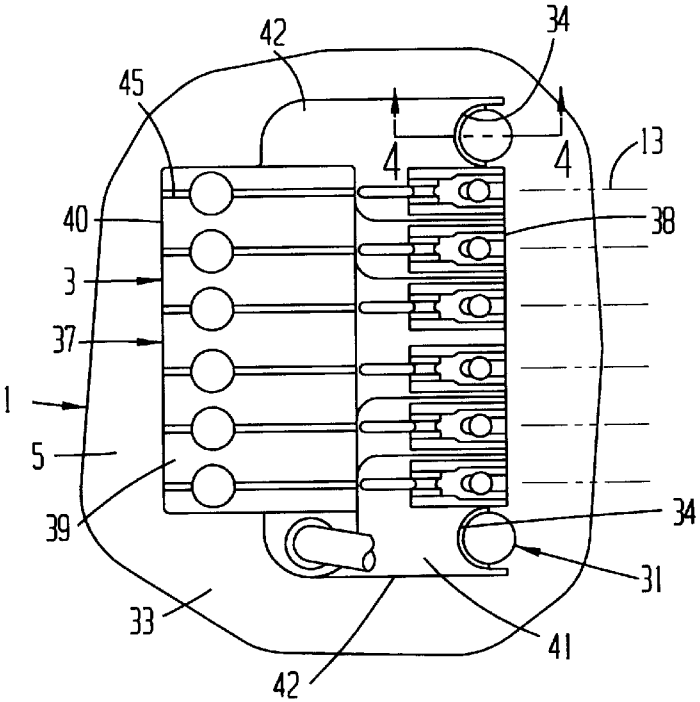
FIG. 3 is a front view of the retrofit tremolo of the invention.
Figure 5:
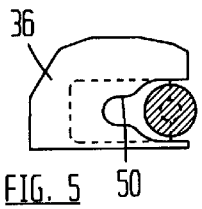
FIG. 5 is a cross-sectional view taken along line 5—5 of FIG. 4.
Figure 4:
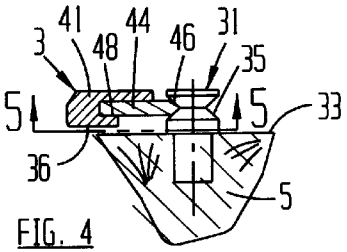
FIG. 4 is a cross-sectional view taken along line 4—4 of FIG. 3.

The strings 13 are tensioned by means of the turning pegs 15 and fine tuners 69 to the desired amount. In FIG. 7, the strings are shown with a tension that exactly equals the force of the springs 29 such that the bridge bottom surface 36 does not contact the guitar body 5. In that situation, the retrofit tremolo 3 is said to float. The retrofit tremolo can be pivoted in both directions about the posts 31 by means of an arm 91 to either decrease or increase the tension in all the strings simultaneously. It will be appreciated, however, that the strings can be tensioned to an amount slightly less than the spring force. In that situation, the bridge bottom surface 36 contacts the guitar body at the bridge back end 40. The arm 91 can then be operated in only one direction to decrease string tension.

In summary, the results and advantages of guitars and other stringed instruments can now be more fully realized. The retrofit tremolo 3 provides both a simple replacement for original equipment tremolos as well as high quality operation. This desirable result comes from using the combined functions of the knife edge inserts 44 and the intonation blocks 49. The knife edge inserts are designed to contact and pivot about posts 31 that are already part of the guitar. The spring plate 43 is designed to accommodate the springs 29 already present on the guitar to be retrofit. The fine tuners 69 provide easy incremental adjustment of the strings 13, and the fine tuner tips 83 with the rounded ends 84 easily engage the strings during setup. The rollers 65 in the intonation blocks prevent any catching of the strings while adding minimal complexity to the retrofit tremolo.

It will also be recognized that in addition to the superior performance and easy installation of the retrofit tremolo, its construction is such as to be substantially less expensive than the tremolos it replaces. Also, the simple and rugged design of the retrofit tremolo assures that it gives long service life with minimal maintenance. On the other hand, the knife edge inserts are readily replaceable when they become worn.

Thus, it is apparent that there has been provided, in accordance with the invention, a retrofit guitar tremolo that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tremolo comprising:

a. a bridge having front and back ends, opposed sides, a bottom surface, and a spring plate depending from the bottom surface, the bridge having means for receiving first ends of musical strings, wherein:

i. the bridge front end is formed with a pair of recessed; and ii. a knife edge insert is held in each recess, and wherein the bridge is formed with an indentation between each recess and the bridge bottom surface, the indentations providing larger exposed areas of the inserts available from the bridge bottom surface to aid in removing the inserts from the bridge;

b. a plurality of intonation blocks adjustably lockable to the bridge, the intonation blocks supporting respective musical strings; and c. a pair of knife edge inserts removeably held in the bridge front end, the knife edge inserts being replaceable when worn by fresh inserts.

2. A tremolo comprising:

a. a bridge having front and back ends, opposed sides, a bottom surface, and a spring plate depending from the bottom surface, the bridge having means for receiving first ends of musical strings;

b. a plurality of intonation blocks adjustably lockable to the bridge, the intonation blocks supporting respective musical strings;

c. a pair of knife edge inserts removeably held in the bridge front end, the knife edge inserts being replaceable when worn by fresh inserts; and d. a plurality of fine tuners in operative association with respective musical strings, each fine tuner comprising:

i. a threaded thumb screw that engages the bridge; and ii. a tip loosely held in the thumb screw, the tip having a semi-cylindrical end defined by a first access, and a notch having an apex that is perpendicular to the first axis.

3. In combination with a guitar having a plurality of strings with respective first and second ends, means for adjustable holding the first ends of the strings, a body with a cutout therethrough, posts embedded in the body, and at least one guitar spring connected to the body.

a retrofit tremolo comprising:

a. a bridge having a block that fixedly receives the second ends of the strings, a bridge support plate, and a spring plate within the guitar body cutout, said at least one guitar spring being connected to the spring plate, wherein:

i. the bridge is formed with a pair of recesses; and ii. a knife edge insert is removeably held in each recess; and b. knife edge inserts removeably held in the bridge that contact the guitar posts and that enable the bridge to pivot about the posts, wherein the bridge is further formed with indentations that open into the recesses, the indentations providing increased exposed areas of the knife edge inserts to thereby facilitate removing the knife edge inserts from the bridge.

4. In combination with a guitar body having a plurality of strings with respective first and second ends, means for adjustably holding the first ends of the strings, a body with a cutout therethrough, posts embedded in the body, and at least one guitar spring connected to the body, a retrofit tremolo comprising:

a. a bridge having a block that fixedly receives the second ends of the strings, a bridge support plate, and a spring plate within the guitar body cutout, said at least one guitar spring being connected to the spring plate;

b. knife edge inserts removeably held in the bridge that contact the guitar posts and that enable the bridge to pivot above the posts;

c. a plurality of intonation blocks each supporting a respective string between the first and second ends thereof such that each string has a first section between the intonation block and the first end, and a second section between the intonation block and the second end; and d. a plurality of fine tuners in operative association with the second sections of the respective strings, each fine tuner having a longitudinal centerline that is perpendicular to the associated string second section, wherein each fine tuner comprises:

i. a thumb screw; and ii. an end piece rotatably received in the thumb screw, the end piece having a tip with a semi-cylindrical surface defined by a tip axis and a notch in the semi-cylindrical surface having an apex that is perpendicular to the tip axis.

* * * * *